United States Patent [19]

Daniels

[11] 4,299,064

[45] Nov. 10, 1981

[54] TUB SURROUND KIT AND METHOD OF ASSEMBLY

[76] Inventor: Phillip D. Daniels, 4797 Lake Bluff, West Bloomfield Township, Oakland County, Mich. 48033

[21] Appl. No.: 51,730

[22] Filed: Jun. 25, 1979

[51] Int. Cl.[3] ..... A47K 3/16

[52] U.S. Cl. ..... 52/35; 52/288; 52/417; 4/580; 4/584

[58] Field of Search ..... 52/36, 35, 416, 417, 52/288; 248/220.1; 4/146, 148

[56] References Cited

U.S. PATENT DOCUMENTS

| | | | |
|---|---|---|---|
| 1,661,168 | 3/1928 | Davis et al. . | |
| 1,774,121 | 8/1930 | Wilson | 52/417 |
| 1,833,672 | 11/1931 | De Vol | 52/277 |
| 2,535,422 | 12/1950 | Jones | 206/60 |
| 2,677,268 | 5/1954 | Hobbs | 52/35 |
| 3,229,438 | 1/1966 | Flagan | 52/588 |
| 3,277,617 | 10/1966 | McBride | 52/35 |
| 3,281,172 | 10/1966 | Kuehl | 52/588 |
| 3,314,203 | 4/1967 | Hill et al. | 52/288 |
| 3,462,900 | 8/1969 | Morrissey | 52/312 |
| 3,559,356 | 2/1971 | Koral | 52/254 |
| 3,564,788 | 2/1971 | Moore | 52/270 |
| 3,626,650 | 12/1971 | Lickliter et al. | 52/288 |
| 3,740,908 | 6/1973 | Moore | 52/261 |
| 3,803,789 | 4/1974 | Gibson | 52/471 |
| 3,854,268 | 12/1974 | Gutner | 248/220.1 |
| 3,977,136 | 8/1976 | Daniels | 52/35 |
| 3,996,703 | 12/1976 | Daniels | 52/35 |
| 4,020,602 | 5/1977 | Daniels | 52/35 |
| 4,109,426 | 8/1978 | Dobija | 52/35 |

FOREIGN PATENT DOCUMENTS

| | | | |
|---|---|---|---|
| 690554 | 7/1964 | Canada | 52/288 |
| 769347 | 10/1967 | Canada | 52/288 |
| 225014 | 2/1969 | Sweden . | |
| 568852 | 4/1945 | United Kingdom . | |
| 937757 | 9/1963 | United Kingdom . | |

*Primary Examiner*—James L. Ridgill, Jr.
*Attorney, Agent, or Firm*—Hiram P. Settle

[57] ABSTRACT

Both a tub surround kit and a method for installing a tub surround are disclosed. The kit comprises four wall panels for covering the back and two side walls surrounding a tub, and two corner panels for covering the joints between the back wall and the two side walls surrounding the tub. The two corner panels each include a pair of orthogonally disposed flanges which terminate in flared, flexible lips for overlapping adjunct edges of the four panels, thereby joining the four wall panels together. The back faces of the flanges of each of the corner panels are adhered or otherwise affixed to the wall corners so that the flared, flexible lip or each of the flanges is yieldably deformed around the edge of the adjacent panel in overlapping relationship.

2 Claims, 4 Drawing Figures

TUB SURROUND KIT AND METHOD OF ASSEMBLY

BACKGROUND OF THE INVENTION

The installation and upkeep of waterproof tile walls around a bath or shower unit has been both expensive and difficult to maintain. The installation of such walls normally requires the services of a skilled laborer, and hence is expensive. Further, the grout and caulking between these tiles tends to crack and flake off with age, resulting in both the loss of the waterseal between the tiles, as well as the aesthetic appearance of the walls. Moreover, the resulting cracks and fissures retain moisture which facilitates the growth of unsightly molds and fungi therein, which further spoils the appearance of the walls. If the resulting cracks and fissures are not regularly cleaned and filled by new grout and caulking, the moisture generated by bath and shower mists will ultimately seep through the edges of the tiling, causing the tiles to loosen and fall off and necessitating an expensive partial or complete replacement of the tiling.

One solution of the problems associated with bath tile installation of a plastic or fiberglass tub surround over the walls surrounding the bath or shower. Examples of such tub surrounds are disclosed in U.S. Pat. Nos. 3,996,703 and 4,109,426.When installed in a new home, such surrounds obviate the need for bathwall tiling. When installed in an older home, such surrounds completely cover cracking and fungus stained bath tiling and replace it with an entirely new wall surface which is substantially waterproof, easily washable, and aesthetically pleasing.

However, the relatively complicated shapes of some of the component parts of each of these two tub surrounds renders them unduly expensive to fabricate and unnecessarily costly to the consumer. For example, the 3,996,703 patent teaches fabricating each of the three wall panels of the tub surround structure with special enlargements and edge flanges so that the wall panels will engage the corner panels in a proper overlapping relationship. Further, the 4,109,426 patent teaches circumscribing the cover panels with a narrow flange, and offsetting each of the legs of the corner panels so that the edges of the wall and corner panels will properly engage in overlapping relationship. As these two examples are fairly illustrative of the present state of the tub surround art, it is clear that the prior art has as yet failed to provide the consumer with a tub surround comprised of simple, inexpensively fabricated wall and corner panels which are capable of neatly overlapping one another in substantially water tight relationship.

Additionally, the tub surrounds are sold as kits by houseware dealers, home improvement centers and discount stores. The kit must fit within a box of minimal size for inventory and sales purposes and for ease of transport and installation by the user.

SUMMARY OF THE INVENTION

The tub surround kit of the invention provides the consumer with a simple, inexpensive and effective solution to the problem of bath tile installation and maintenance without any of the previously discussed shortcomings of the prior art. Further, the kit fits within a smaller box than those previously on the market. The kit comprises four identically sized flat wall panels, an "H" joint, and a pair of corner panels for completely covering the side walls and back wall surrounding a tub.

The corner panels each include a pair of orthogonally disposed flanges which terminate in flared flexible lip portions.

In operation, one of the flat wall panels is affixed onto each of the two side walls so that one of the sides of the panels is even with the side of the tub while the other side of the panel is spaced approximately three to six inches from the corners of the side walls and the back wall. The remaining two panels are affixed onto the back wall with their mutually adjacent sides joined by the H joint, and their corner sides spaced three to six inches from the corners of the side walls and the back walls. The two corner panels are affixed into the two corners formed by the side walls and the back wall so that their respective flanges cover the gaps between the wall panels and the corners, while the flexible, flared lips located at the outer edges of these flanges yieldably conform around the corner edges of the panels, thereby forming a completed tub surround.

The wall panels are preferably formed from a flexible, heat deformable sheet material, so that they may be conveniently vacuum formed into corner panels having flexible, flared lips.

DETAILED DESCRIPTION OF THE INVENTION

Figure 1:
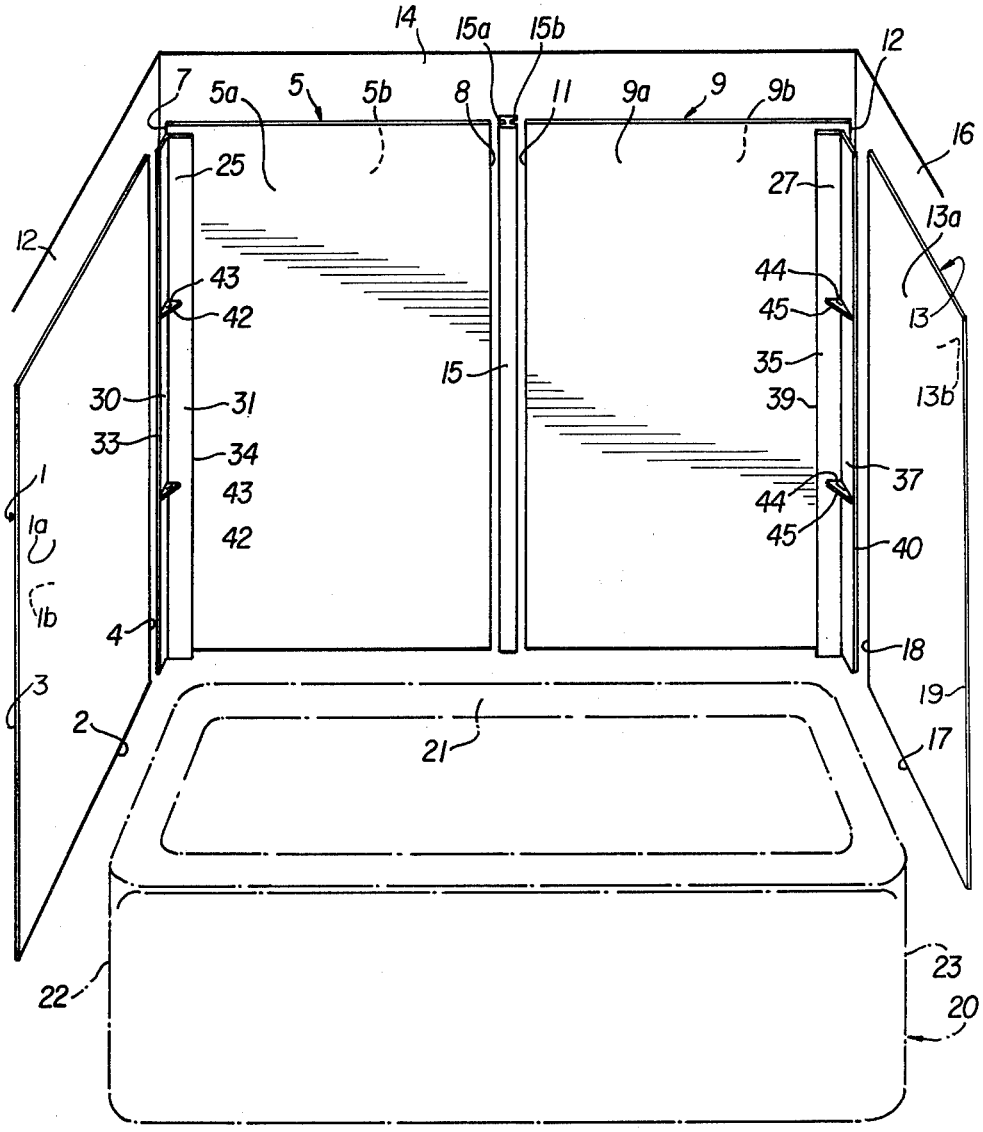
FIG. 1 illustrates a perspective, exploded view of the tub surround of the invention.

With reference now to FIG. 1, the tub surround kit generally comprises four wall panels 1, 5, 9 and 13, and an "H" joint 15 and a pair of corner panels 25, 27.

In the preferred embodiment, each of the wall panels 1, 5, 9 and 13 measures approximately 25 inches by 55 inches. The panels 1, 5, 9, 13 are preferably fabricated from sheets of a flexible, inexpensive waterproof plastic material so that the final structure will be both inexpensive and waterproof. Further, the plastic material forming the panels 1, 5, 9, 13 is preferably heat deformable in order to facilitate the economical manufacture of the corner panels 25, 27 from the same pieces of sheet material forming the panels, as will be explained in more detail hereafter. Finally, each of the panels 1, 5, 9, 13 preferably has a fininshed face 1*a*, 5*a*, 9*a*, 13*a* for facing the tub after installation, and an unfinished face 1*b*, 5*b*, 9*b* and 13*b* adapted to adheringly receive a waterproof, pressure sensitive adhesive pursuant to the installation of the kit, as will now be explained.

The kit is adapted to be installed on the walls 12, 14, 16 surrounding the head, back and foot portions of a conventional bath tub 20. As a first step, panel 1 may be affixed onto side wall 12 by applying an adhesive mastic material to its unfinished face 1*b*, although any type of waterproof, pressure sensitive adhesive could be used. After the adhesive is applied, the rough face 1*b* of panel 1 is then pressed onto wall 12 with the bottom edge 2 of panel 1 preferably aligned with and abutting the upper rim 21 of bathtub 20, and side edge 3 even with the edge 22 of the tub 20. Since the average tub side wall varies in width from between 28 and 30 inches, and the width of each of the wall panels is 24 inches, mounting the panel onto the wall 12 in the manner previously described leaves approximately a 4 to 6 inch gap of uncovered wall between the corner edge 4 of panel 1 and the corner formed between side wall 21 and back wall 14.

As a second step, panel 13 may be affixed onto side wall 16 in exactly the same way panel 1 was affixed to side wall 12, with its bottom edge 17 aligned with and abutting the top edge 21 of the bathtub 20, and its side edge 19 even with side edge 23 of the bathtub. Again, because the average bathtub varies in width from between 28 and 30 inches, and the width of each of the panels is 24 inches, affixing the panel 13 onto the wall 16 in this manner leaves a 4 to 6 inch gap of uncovered wall between the corner edge 18 of the panel 13 and the corner formed between side wall 16 and back wall 14.

At this juncture, it should be noted that, if plumbing fixtures such as faucets and spigots impair the installation of either wall panel 1 or wall panel 13, the flexible plastic material forming the wall panels of the invention facilitates the cutting of appropriate holes in the panels 1, 13 to accommodate these fixtures.

As a third step, the width of back wall 14 may be measured to determine whether of not back wall panels 5 and 9 should be trimmed prior to installation. Proper operation of the invention depends in part on the existence of gaps between the wall corners and the corner edges 4, 7, 12, 18 of the panels 1, 5, 9, 13. Since back tub walls such as wall 14 may vary in width anywhere between forty and sixty two inches, the corner edges 7, 12 of panels 5, 9 may have to be trimmed in order that the required corner gaps may exist when the panels 5, 9 are affixed to the back wall 14.

After all necessary trimming has been completed, panel 5 may next be affixed onto the back wall 14 in much the same manner as panel 1 was affixed to wall 12, with the exception that side edge 8 is preferably aligned with the midpoint of back wall 14, instead of with one of the tub edges 22, 23.

Figure 2:
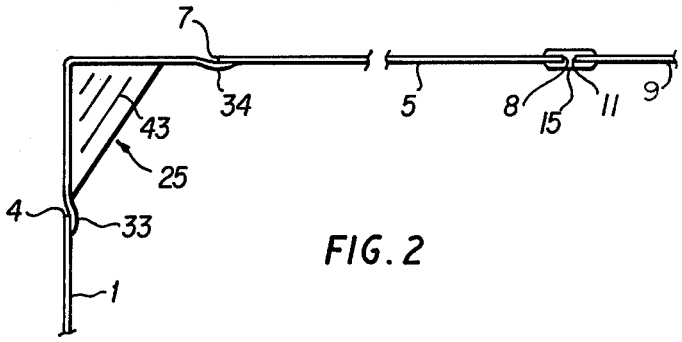
FIG. 2 illustrates a top plan view of the corner panels of the invention in position on the back and side walls surrounding a tub.

As a fifth step, H joint 15 may be installed in watertight relation to the side edge 8 of panel 5 by filling grooves **15*a* and 15*b* with adhesive mastic and inserting side edge 8 into the filled groove 15*a* in the position illustrated in FIGS. 1 and 2**.

As a sixth step, panel 9 may be affixed to back wall 14 in much the same way as panel 5, with the exception that side edge 11 is inserted into groove **15*b* of H joint 15, instead of being aligned with the center point of back wall 14**.

As a seventh and final step, corner panels 25, 27 may be installed in the corners formed by side wall 12 and back wall 14, and side wall 16 and back wall 14, respectively. Each of the corner panels 25, 27 includes a pair of orthogonally disposed flanges 30, 31 and 35, 37 preferably formed from the same flexible, heat deformable plastic sheet material as panels 1, 5, 9, 13 for reasons which will soon become apparent. Each of these flanges 30, 31, 35, 37 terminates in a flared, flexible lip portion 33, 34, 39, 40 which is preferably flared away from the substantially planar surface of its respective flange 30, 31, 35, 37 at a 45° angle. Each of the corner panels 25, 27 are installed in much the same way as the panels 1, 5, 9, 13 by applying a pressure sensitive adhesive such as mastic, to the back faces of the flanges 30, 31, 35, 37 of the corner panels, and pressing them against the corners of the walls 12, 14 and 14, 16 with their bottom edges flush against the upper rim 21 of the bathtub 20.

With reference now to FIG. 2, when the corner panels 25, 27 are installed in the manner described, the flexibility of the flared lips 33, 34, 39, 40 of the flanges of the corner panels causes them to yieldably conform around the corner edges 47, 12, 18 of the panels 1, 5, 9 and 13, thereby forming a watertight joint between the corner edges 4, 7, 12 18 of the panel and the corner pieces 25, 27.

Corner pieces 25, 27 may also include one or more shelves 42, 44 with integrally formed ridges 43, 45 for conveniently holding soaps, shampoos, or bathing utensils. The integrally formed ridges 43, 45 on each of the shelves 42, 44 allow water to drain from wet bars soap placed onto the upper surfaces of these shelves. Additionally, the upper surfaces of the shelves may be formed so as to slope very slightly toward the bathtub 20 which in turn would facilitate the drainage of water therefrom. Each corner shelf 42, 44 terminates short of the deformable lip or flanges 30, 31, 35, 37 so that the flanges remain flexible for conformity to the adjacent planar panel.

Figure 3:
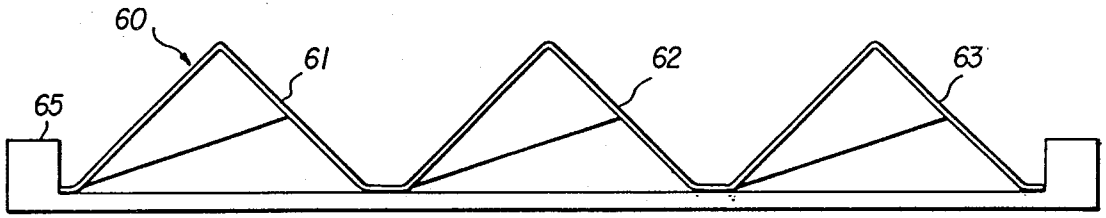
FIG. 3 illustrates a side plan view of a panel of the invention being formed into corner panels.

FIG. 3 illustrates the manner in which corner pieces 25, 27 may be advantageously fabricated from sections of heat deformable sheet material cut the same size as wall panels 1, 5, 9, 13. A panel sized section 60 is heated until it softens, and then placed over a vacuum operated mold 65 of a type well known in the art. The mold 65 applied a vacuum to the underside of the section 60, thereby drawing the section 60 into it and forming three corner panels 61, 62, 63 as shown.

Figure 4:
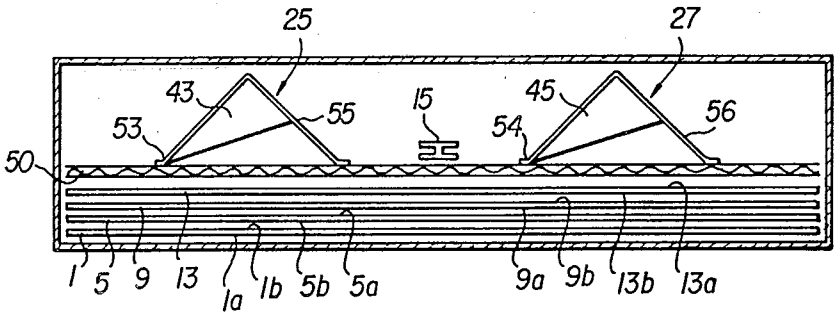
FIG. 4 illustrates a side plan view of the invention as packaged for shipping.

With reference now to FIG. 4, the bathtub kit may be packaged by stacking the four panels 1, 5, 9 and 13 in the manner illustrated, with the unfinished faces **1*b*, 5*b*, and 9*b*, 13*b* facing one another so that none of the unfinished faces 1*b*, 5*b*, 9*b* and 13*b* rubs against any of the finished faces 1*a*, 5*a*, 9*a*, 13*a*. Packaging 50 is preferably placed between clear face 13*a* of wall panel 13** and the two corner panels as shown.

FIG. 4 also illustrates two packaging advantages associated with the invention. First, when corner panels 25, 27 include shelves 43, 45 which extend from the edges 53, 54 of one of their flexible lips to the midpoint 55, 56 of one of their flanges, the corner panels 25, 27 advantageously serve as shock absorbers by flexing at points 55 and 56, respectively, especially when the corner panels are placed with their lips in contact with packing 50 as shown. Second, since the wall panels 5, 7, 9, 13 are only twenty four inches wide, the entire tub surround may be placed in a package only slightly over twenty four inches wide by five inches high by fifty five inches long, making it the most compactly packaged tub surround available.

It should be noted that the preceding detailed description is only illustrative of the preferred embodiment of the invention, and that numerous changes both in design, material, and procedure may be made without departing from the scope of the apparatus and method of the invention.

Having described both the apparatus and method of the best mode of the invention in such full, clear concise and exact terms as to enable any person skilled in the art to practice the invention, I claim:

1. A tub surround kit comprising:

(1) four identically sized panels, each of a width dimension to substantially cover either the end walls or one-half of the back wall of a standard tub recess, (2) a single "H"-shaped joint having a height dimension equal to the height of said panels and having laterally opening elongated recesses for receiving the edge of a panel therein, and (3) two angular corner members of a height dimension equal to the height of the panels and having side walls mutually perpendicular to one another, each side wall terminating in a flared, yieldably deformable lip, said kit fitting into a package having an interior packing space corresponding to the length and width dimension of said identical panels and of a thickness equal to the stacked panels and corner members, plus any packing materials; and wherein the kit fits a standard 54 inch tub, said panels are each about 24 inches wide, and the interior package dimension is about 24 inches in width and about 5 inches in thickness and the interior length dimension is the same as the height of the panels.

2. A tub surround entirely manufactured of thermoplastic sheet material and adapted to cover the back and side walls of a standard tub recess, said surround comprising:

(1) four identically sized panels, one of said panels being applied to and substantially covering each of the end walls of a tub recess, and the other two panels being secured in spaced relation to the back wall of the tub recess, said panels each substantially covering the walls to which they are applied, any gaps between the panels being confined to the recess corners and to a space between the panels on the back wall, (2) a single "H"-shaped joint having a height dimension equal to the height of said panels and interposed between the two panels attached to the back wall of the recess to cover the space therebetween, the panels adhered to said back wall having their edges projecting into elongated recesses of the joint, and (3) two corner members of the same height dimension as that of said panels and having substantially equal side walls which are mutually perpendicular to one another, each of said corner members being interposed between one of the panels adhered to the end wall of the tub recess, the corner member side walls covering any gaps between the panels at the recess corners, and each of said corner members having its side walls terminating in a flared yieldably deformable lip and the side walls of the corner members are adhered at the recess corners, projecting toward the adjacent panel and overlying the adjacent edge of each adjacent panel in sealing relationship therewith.

* * * * *